US005675912A

United States Patent [19]

Thompson

[11] Patent Number: 5,675,912

[45] Date of Patent: Oct. 14, 1997

[54] SAFETY METHOD FOR A DRYING SYSTEM

[75] Inventor: Stanley P. Thompson, Topeka, Kans.

[73] Assignee: Beloit Technologies, Inc., Beloit, Wis.

[21] Appl. No.: 622,526

[22] Filed: Mar. 25, 1996

[51] Int. Cl.[6] ..... F26B 3/00

[52] U.S. Cl. ..... 34/494; 34/411; 34/568

[58] Field of Search ..... 34/493, 494, 411, 34/415, 568

[56] References Cited

U.S. PATENT DOCUMENTS

| | | | |
|---|---|---|---|
| 3,728,797 | 4/1973 | Worden, Sr. et al. | 34/32 |
| 4,838,784 | 6/1989 | Lockwood, Jr. | 432/58 |
| 5,197,203 | 3/1993 | Lenoir | 34/90 |

FOREIGN PATENT DOCUMENTS

| | | | |
|---|---|---|---|
| 2656046 | 6/1978 | Germany | 34/494 |

*Primary Examiner*—Henry A. Bennett
*Assistant Examiner*—D. Doster
*Attorney, Agent, or Firm*—Shook, Hardy & Bacon L.L.P.

[57] ABSTRACT

A dryer system has a combustion chamber, a dryer and a separator. The combustion chamber supplies heated gas to the dryer. Wet material is mixed with the heated gas in the dryer. The dried material is then separated from the gas in the separator. A method is used to increase the safety of the system. The method includes sensing the temperature of the dryer system. Further, if the temperature reaches a predetermined value, the combustion chamber is extinguished. Additionally, upon the temperature reaching the predetermined value, steam is introduced into the dryer system.

12 Claims, 2 Drawing Sheets

SAFETY METHOD FOR A DRYING SYSTEM

BACKGROUND OF THE INVENTION

This invention relates to drying systems in general, and more specifically to a safety method for such drying systems.

Drying systems are important features in the manufacturing and processing of many different materials. For example, drying systems are often used to dry wood chips during the manufacturing of particle board. Further, drying systems are of particular importance during the processing of ethanol. More particularly, after ethanol has been removed from grain during the fermentation process, it is then desirable to dry the grain to allow storage and resale of the grain for animal feed or other uses.

Typical drying systems include a combustion chamber into which natural gas and air are supplied and combusted. The heated combustion gases in the combustion chamber are then introduced by a draft fan into a rotating cylindrical dryer. The material to be dried is introduced into the dryer and exposed to the current of heated gases. The dried material is then separated from the heated gas current in a separator, such as a cyclone separator. The combustion gases introduced into the dryer of a drying system are typically in the range of 400° F. to 1200° F. As is apparent, these elevated temperatures inherently can cause safety problems with a dryer system. More specifically, because a dryer system is typically a closed system in that outside air usually is only introduced into the system at the combustion chamber, there is a potential for explosions to occur. Fires within the closed system can occur for various reasons, for instance, as a result of the material being dried becoming overheated and combusting. The combustion of such material can result in the production of pyrolysis gas within the closed system. This pyrolysis gas is usually highly combustible and if ignited can result in explosions. Further, if outside air is introduced into the closed system, the oxygen within the air can fuel any combustion fires already existing within the system.

Prior art drying systems have done everything reasonably possible, to lessen the possibility of harmful situations that can occur with a dryer system. However, as with all inherently dangerous processes, technology and innovation are needed to make dryer systems that further decrease the risk of harmful situations.

SUMMARY OF THE INVENTION

One object of the present invention is to provide a safety method that allows automatic extinguishment of combustion fires within a dryer system and purging of the harmful gases from the system by the use of the introduction of steam.

Another object of the present invention is to automatically begin a steam flow into a dryer system in response to a temperature overload sensed at various locations within the system.

A further object of the present invention is to provide a two-stage automatic temperature overload sensing where, in response to a first predetermined temperature valve, certain precautionary measures are taken, and thereafter, in response to a second higher predetermined temperature valve, additional precautionary measures are automatically taken.

A still further object of the present invention is to provide a safety method which monitors temperatures at various places within the dryer system and, using various temperature parameters, provides for combustion chamber shutoff, steam purging of the system, and/or shutoff of the system fan.

Additional objects, advantages, and novel features of the invention will be set forth in part in the description which follows and, in part, will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith.

DETAILED DESCRIPTION OF THE PREFERRED EMBODIMENT

Figure 1:
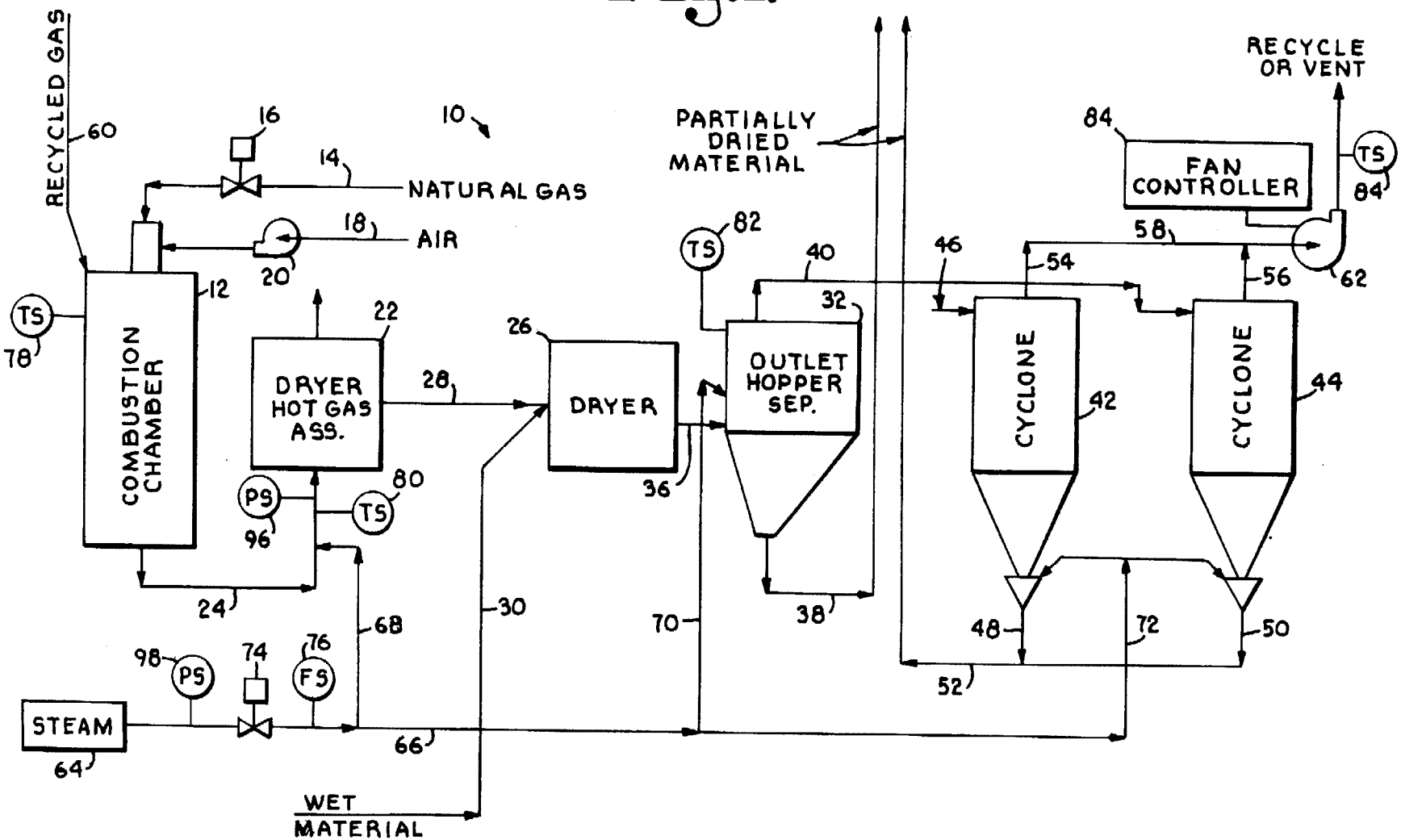
FIG. 1 is a diagrammatic view of a drying system utilizing the safety method of the present invention.

With reference to FIG. 1, a drying system 10 utilizing the safety method of the present invention is shown diagrammatically. A combustion chamber 12 is supplied with natural gas via an inlet line 14. Line 14 has a motorized guillotine valve 16 disposed therein to control the flow of gas to chamber 12. Air is also supplied to chamber 12 via an inlet line 18 and a fan 20. Combustion chamber 12 supplies a current of heated gas to a dryer inlet assembly 22 via duct of 24. The current of heated gas is then supplied to dryer 26 from assembly 22 via a duct 28. Wet material to be dried is also introduced into dryer 26 as indicated by the feed conduit 30. In dryer 26 the wet material is exposed to the heated gas current so that the moisture content of the material is reduced. The current of heated gas flowing through dryer 26 serves to convey the wet material therethrough.

After the moisture content of the material has been reduced in dryer 26, the material and the current of heated gases are conveyed to an outlet hopper separator 32 via a duct 36. Separator 32 serves to separate the very coarse partially dried material from the fine material and the heated gases. The coarse materials are conveyed via conduit 38 to either a dried material pile or to another dryer system for a further drying, as will be more fully explained below. The fine material and the heated gases are conveyed via duct 40 to cyclone separator 42 and cyclone separator 44. The mixture of fine material and heated gases are equally separated at point 46 in duct 44 so that one half of the flow goes to cyclone 42 and the other half to cyclone 44. In cyclones 42 and 44, the heated combustion gases are separated from the fine material. The fine material exits the lower ends of cyclones 42 and 44 via exit conduits 48 and 50, respectively, which join with material conduit 52. As with material conduit 38, conduit 52 serves to convey the partially dried material to a dry pile or to other dryer systems, as will be more fully described.

The heated gases exit the upper ends of cyclones 42 and 44 via exit ducts 54 and 56. Ducts 54 and 56 join with duct 58 which serves to convey the separated combustion gases back to combustion chamber 12 as recycled gases, as indicated by inlet duct 60, or to other dryer systems as recycled gas, or to vent the gases to the atmosphere. A draw fan 62 is disposed in duct 58. Fan 62 serves to create a vacuum within the dryer system 10 so as to aid in the flow of the material and gases through the system. More specifically, system 10 is a closed system in that substantially the only place that air is introduced into the system is in the combustion chamber 12 via air line 18. Other than this air entry, the lines, ducts and conduits are all enclosed to inhibit air from entering the closed system.

Dryer system 10 can be easily coupled with a plurality of identical dryer systems. More specifically, typically the partially dried material exiting system 10 through conduits 38 and 52 are conveyed to one or more other dryer systems to be further dried. Further, the heated combustion gases exiting via duct 58 and fan 62 can also be conveyed to the combustion chambers of other dryer systems as recycled gas. That is, a portion of the heated combustion gases exiting this system can be conveyed back to combustion chamber 12 via duct 60, and another portion of the heated gases can be conveyed to the other combustion chambers of other systems as recycle gas.

The safety features of the present invention provide a steam supply system for injecting steam at various locations within system 10. The steam supply system includes steam supply or boiler 64. Steam exits boiler 64 via steam line 66. Line 66 has three separate steam supply branches 68, 70 and 72. Branch 68 supplies steam to the dryer system 10 by introducing the steam into duct 24. Branch 70 supplies steam to the dryer system by introducing steam into separator 32. Branch 72 supplies steam to the dryer system by introducing steam into the lower ends of both cyclone separators 42 and 44. Steam line 66 has a motorized control valve 74 disposed therein to automatically control the flow of steam exiting boiler 64. Further, a flow sensor 76 is positioned after valve 74 in line 66. Flow sensor 76 is able to measure whether or not steam is flowing within line 66. Flow sensor 76 can be of any suitable type, for instance, an orifice plate-type sensor. The control and operation of valve 74 and sensor 76 will be more fully described below.

The dryer system has a variety of overload temperature sensors for sensing the temperature of the dryer system at various locations. Temperature sensor 78 monitors the temperature in combustion chamber 12. Temperature sensor 80 monitors the temperature in duct 24 leading into dryer assembly 22. Temperature sensor 82 monitors the temperature in separator 32. Temperature sensor 84 monitors the temperature in duct 58 after fan 62. Temperature sensors 78, 80, 82 and 84 can be of any suitable type, such as a thermal couple or the like.

Figure 3:
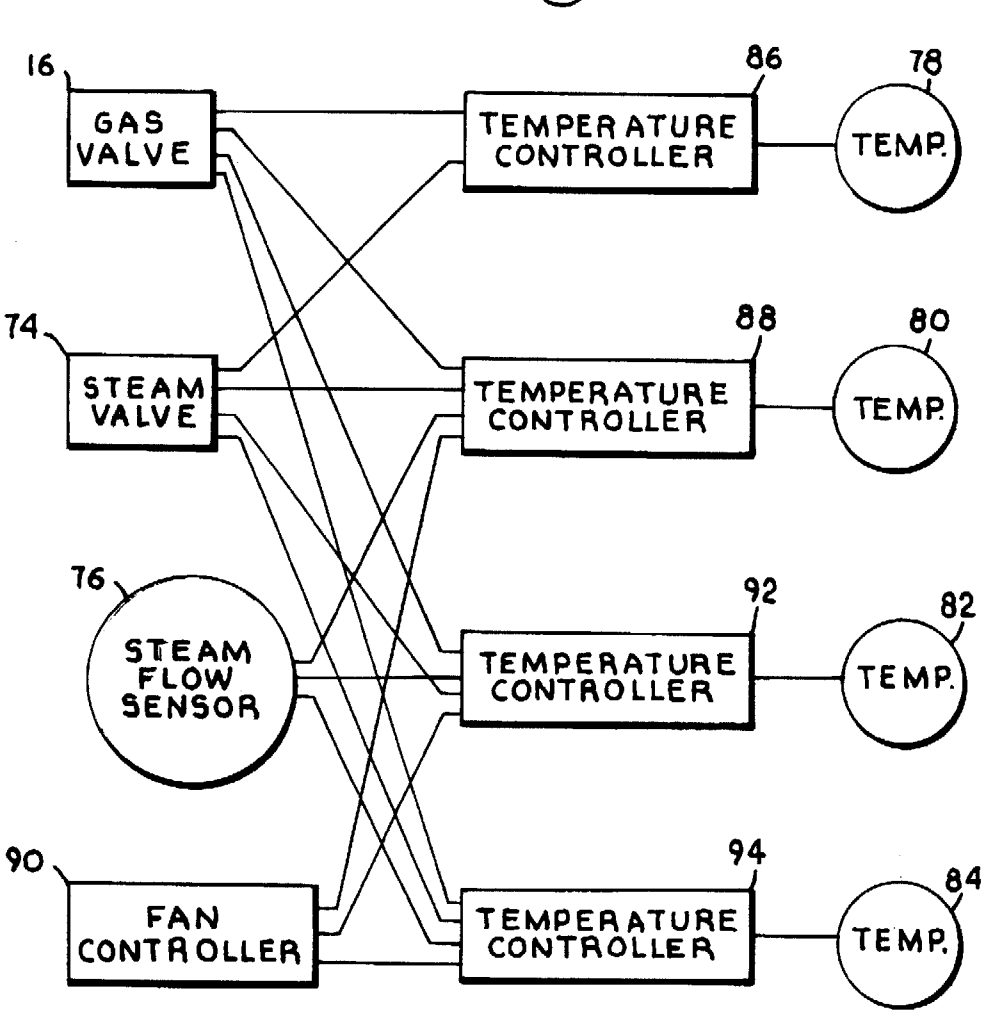
FIG. 3 is a schematic of the electrical connections between the temperature sensors, temperature controllers, and various other structures disposed within the drying system of FIG. 1.

With reference to FIG. 3, the schematic electrical arrangement of the temperature sensors is shown. Temperature sensor 78 is electrically connected to a temperature controller 86 which in turn is electrically connected to gas valve 16 and steam valve 74. Sensor 78 senses the temperature within combustion chamber 12, and after the temperature within combustion chamber 12 reaches a certain overload level, temperature controller 86 will actuate gas valve 16 to shut off the flow of natural gas to combustion chamber 12, thus extinguishing the burner flame within the combustion chamber. Further, controller 86 will actuate steam valve 74 so that steam is allowed to flow into the dryer system at the above-described locations. As is apparent, the shutting down of the combustion chamber will prevent further combustion gases from being introduced into the dryer system, thus lessening the possibility of fires and explosions. Additionally, the introduction of steam into the system at the various locations will serve to extinguish fires that may have developed within the system, and, further, will serve to purge the entire system of oxygen and flammable pyrolysis gases. The purging of the system of oxygen and pyrolysis gas results in a lessening of the chance of fires and explosions.

Figure 2:
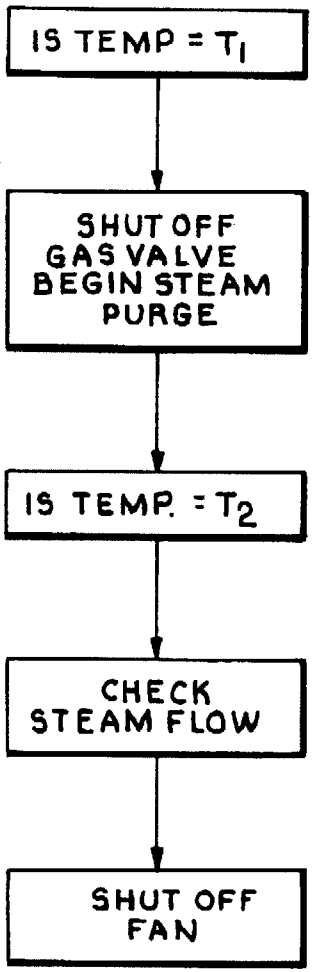
FIG. 2 is a flow chart showing the temperature logic used within a temperature controller to determine the appropriate safety steps to be taken.

Temperature sensor 80 which is disposed in duct 24 leading to assembly 22 is electrically connected to a temperature controller 88. Temperature controller 88 is in turn electrically connected to gas valve 16, steam valve 74, steam flow sensor 76 and fan controller 90. Temperature sensor 80 sends the temperature it senses to temperature controller 88. In response thereto temperature controller 88 can perform a variety of safety operations depending upon the overload temperature sensed. More specifically, FIG. 2 is a flow chart of the sequence temperature controller 88 performs. The first step controller 88 does is determine if the temperature sensed by sensor 80 is at or above a predetermined overload temperature $T_1$. Thereafter, if the temperature is at or above $T_1$, controller 88 will actuate gas valve 16 so that the flow of natural gas into combustion chamber 12 is prevented and combustion chamber 12 is extinguished. Further, controller 88 will actuate steam valve 74 to flood the dryer system with steam. As described above with respect to sensor 78, the extinguishment of combustion chamber 12 and the steam flooding serves to reduce the risk of fires and explosions within the dryer system. Controller 88, however, continues to monitor the temperature sensed by sensor 80. If the temperature sensed reaches a higher overload temperature $T_2$, temperature controller 88 will then check to make sure that steam is flowing through line 66 through the use of flow sensor 76. If steam is flowing through line 66, controller 88 will then electrically signal fan controller 90 to shut down fan 62. If steam is not flowing through line 66, controller 88 will allow fan 62 to continue to run. The reasons for the controller making these decisions will be more fully described below.

Temperature controller 92 and temperature controller 94 which are electrically connected to temperature sensors 82 and 84, respectively, operate in the same manner as temperature controller 88. More specifically, controllers 92 and 94 are each electrically connected to gas valve 16, steam valve 74, flow sensor 76 and fan controller 90. Therefore, in response to the temperature sensed at the location of sensors 82 and 84, controllers 92 and 94 will perform the same logic flow shown in FIG. 2.

With reference to FIG. 2, and as described above, controllers 88, 92 and 94 only shut down fan 62 after they have confirmed that there is steam flow through line 66. The reason for shutting fan 62 down only if there is steam flow involves an evaluation or "weighing" of what is potentially the most dangerous situation for the dryer system. More specifically, if the temperature at sensors 80, 82 or 84 continues to rise, even after steam has been flowing through the system purging it of oxygen and pyrolysis gases, there is likely a serious air leak somewhere in the closed dryer system which is allowing the combustion of material and the continual rise in temperature. By shutting off fan 62, with the steam flowing, the likelihood of air from the atmosphere entering the dryer system through the leak is reduced, thus reducing the possibility that oxygen can fuel the combustion and continue to create a dangerous situation. If, however, steam is not flowing into the system due to a failure of the steam supply system, for instance a failure of boiler 64, it is advantageous to leave fan 62 on. More specifically, because there is no steam purge going on in the system, if fan 62 is shut off, combustion products in the system would not be moved or purged out of the system. Therefore, if the temperature $T_2$ is reached and steam flow is not purging the system of oxygen or other pyrolysis gas, it is in the interest of safety to continue running fan 62 in an attempt to keep the gases moving through the system and, thus, possibly prevent a buildup of combustible gases and a possible resulting explosion. Thus, each controller 88, 92 and 94 performs an important two-step monitoring function. More specifically, each controller, in light of the temperature and steam flow will make an automatic determination to provide the system with the less risky operation in an overload temperature situation.

The number of temperature sensors and the location of the temperature sensors can be varied for a particular type of system depending on the structures found in that system and the material to be dried in the system. In the preferred embodiment described, there are four separate temperature sensors 78, 80, 82 and 84 used. However, some of these temperature sensors may not be necessary. For instance, it has been found that a large majority of fires in a closed dryer system will occur within the separating structures 32, 42 and 44. More specifically, it is within these structures that you have dried material which is more susceptible to combustion rather than the wet material introduced into dryer 26. Therefore, positioning temperature sensor 84 in duct 58 where it can easily detect a rise in temperature in cyclone separators 42 and 44 and positioning temperature sensor 82 in separator 32 so it can readily detect a rise in temperature therein, offers an advantageous way of monitoring this particularly high risk area. Further, the temperature sensor 80 located in duct 24 exiting combustion chamber 12, and temperature sensor 78 located in combustion chamber 12 both allow easy monitoring for possible overload temperatures in relation to the combustion chamber. More specifically, oftentimes very fine dried material may be included in the recycled gas introduced into chamber 12 by duct 60. Therefore, this fine material may build up in combustion chamber 12. The buildup may obviously be ignited by the burner flame within the chamber, thus creating an over-temperature situation. Temperature sensors 78 and 80 will monitor closely this other potentially high risk area. As is apparent, where there may be other potentials for fires, an appropriate temperature sensor can be located at any other location where the fire potential is high.

In addition to the temperature sensors, a pressure sensor 96 can be located in duct 24 as shown in FIG. 1. If pressure sensor 96 senses a predetermined value of increase in pressure, sensor 96 will operate to shut down gas valve 16 and begin steam purging by opening valve 74. Therefore, pressure sensor 96 offers a further safety feature which will respond to a predetermined increase in pressure within the system. By extinguishing the burner flame in combustion chamber 12, and purging the system with steam, again the possibilities of a fire or explosion are reduced.

In addition to pressure sensor 96, another pressure sensor 98 can also be disposed in steam line 66 prior to valve 74. Sensor 98 can be hooked up to the overall operating system such that before the system is even started, it is verified that there is steam pressure. If there is not adequate steam pressure sensed at pressure sensor 98, the startup of the entire system will not be allowed.

As is apparent, the temperature sensors and pressure sensors described above can be utilized in other dryer systems connected to dryer system 10. In other words, sensors can be located as they are in dryer system 10 in the other connected dryer systems such that each dryer system has a separate safety and control system.

I claim:

1. A safety operating method for a dryer system, the dryer system having a combustion chamber, a dryer and a separator, the combustion chamber supplying heated gas to the dryer, wet material being mixed with the heated gas in the dryer, and dried material being separated from the gas in the separator, the method comprising:

sensing the temperature of the dryer system;

extinguishing the combustion chamber in response to the temperature reaching the predetermined value; and introducing steam into the dryer system in response to the temperature reaching the predetermined value.

2. The method of claim 1 wherein the temperature sensed is that of the gas after it has been separated from the material in the separator, and wherein the combustion chamber is extinguished and steam is introduced into the dryer system in response to the temperature of the gas reaching the predetermined value.

3. The method of claim 2 wherein a second temperature is sensed, the second temperature being that of the mixture of gas and material after it has exited the dryer, and wherein the combustion chamber is extinguished and steam is introduced into the dryer system in response to the temperature of the mixture reaching the predetermined value.

4. The method of claim 3 wherein a third temperature is sensed, the third temperature being that of gas after it has exited the combustion chamber and prior to it being exposed to the wet material in the dryer, and wherein the combustion chamber is extinguished and steam is introduced into the dryer system in response to the temperature of the gas reaching the predetermined value.

5. The method of claim 1, wherein the dryer system includes a fan for increasing the flow of gases through the dryer system, the method further comprising:

turning off the fan in response to the sensed temperature of the dryer system reaching a second predetermined value that is higher than the first predetermined value.

6. The method of claim 5 further comprising:

sensing whether there is steam flow to the dryer system prior to the fan being turned off.

7. The method of claim 1 further comprising:

sensing the pressure of the dryer system; and turning off the entire dryer system in response to a sensed pressure increase.

8. The method of claim 1 further comprising:

sensing the temperature in the combustion chamber; and extinguishing the combustion chamber if the temperature in the combustion chamber reaches a predetermined value.

9. A method of constructing a safety system for a dryer system, the dryer system having a combustion chamber, a dryer and a separator, the combustion chamber supplying heated gas to the dryer, wet material being mixed with the heated gas in the dryer, and dried material being separated from the gas in the separator, the method comprising:

positioning a temperature sensor so that it senses the temperature of the gas after it has been separated from the material in the separator, and wherein, in response to the temperature of the gas reaching a predetermined value, the combustion chamber is extinguished and steam is introduced into the dryer system; and positioning a second temperature sensor so that it senses the temperature of the mixture of gas and material after it has exited the dryer, and wherein, in response to the temperature of the mixture reaching the predetermined value, the combustion chamber is extinguished and steam is introduced into the dryer system.

10. The method of claim 9 further comprising:

positioning a third temperature sensor so that it senses the temperature of gas after it has exited the combustion chamber and prior to it being exposed to the wet material in the dryer, and wherein the combustion chamber is extinguished and steam is introduced into the dryer system in response to the temperature of the gas reaching the predetermined value.

11. The method of claim 9, wherein the dryer system includes a fan for increasing the flow of gases through the dryer system, the method further comprising:

electrically connecting the fan to the first and second temperature sensors so that the fan can be turned off in response to either of the temperature sensors reaching a second predetermined value that is higher than the first predetermined value of that sensor.

12. The method of claim 11 wherein the dryer system includes a steam flow sensor, the method further comprising:

electrically connecting the steam flow sensor to the first and second temperature sensors so that the existence of steam flow is sensed prior to the fan being turned off.

* * * * *